United States Patent [19]

Justiss

[11] 4,453,031

[45] Jun. 5, 1984

[54] MULTI-COMPARTMENT SCREENED TELEPHONE CABLES

[75] Inventor: Jimmy D. Justiss, Bonham, Tex.

[73] Assignee: GK Technologies, Inc., Greenwich, Conn.

[21] Appl. No.: 441,656

[22] Filed: Nov. 15, 1982

[51] Int. Cl.[3] ..... H01B 11/08

[52] U.S. Cl. ..... 174/36; 174/105 B; 174/106 D; 174/107

[58] Field of Search ..... 174/36, 105 B, 106 R, 174/106 D, 107

[56] References Cited

U.S. PATENT DOCUMENTS

| | | | |
|---|---|---|---|
| 2,125,869 | 8/1938 | Atkinson | 174/105 B |
| 3,622,683 | 11/1971 | Roberts | 174/36 |
| 3,803,340 | 4/1974 | Jachimowicz et al. | 174/36 |
| 3,881,052 | 4/1975 | Britz et al. | 174/103 |
| 4,085,284 | 4/1978 | Olszewski et al. | 174/36 |
| 4,165,442 | 8/1979 | Gabriel et al. | 174/36 |
| 4,221,926 | 9/1980 | Schneider | 174/107 |
| 4,340,771 | 7/1982 | Watts | 174/36 |
| 4,393,582 | 7/1983 | Arnold, Jr. et al. | 174/36 X |

*Primary Examiner*—J. V. Truhe

*Assistant Examiner*—Morris H. Nimmo

*Attorney, Agent, or Firm*—Hopgood, Calimafde, Kalil, Blaustein & Judlowe

[57] ABSTRACT

Three or more groups of individually insulated conductors are optionally separately wrapped with insulating material and then either singly or collectively encircled with metal tape material. The groups are secured together by a strengthening steel tape and surrounding protective jacket. By way of example, a series of embodiments are described, each containing three groups of conductors or cores. Screen configurations are presented for enclosing all groups or only the carrier service groups with one tape element that weaves its way in and out between the groups so that each group or core is screened from all adjacent cores. Other configurations employ separate tapes, each enclosing a separate corresponding group. Finally, embodiments are disclosed in which one group is enclosed by one tape element, while two additional groups are collectively enclosed by a single tape element deployed somewhat "S" shape about the cores. The groups of conductors can consist of different gauge wire with heavier gauge being useful for VF service and lighter gauge for PCM carrier service.

16 Claims, 10 Drawing Figures

Fig. 3.
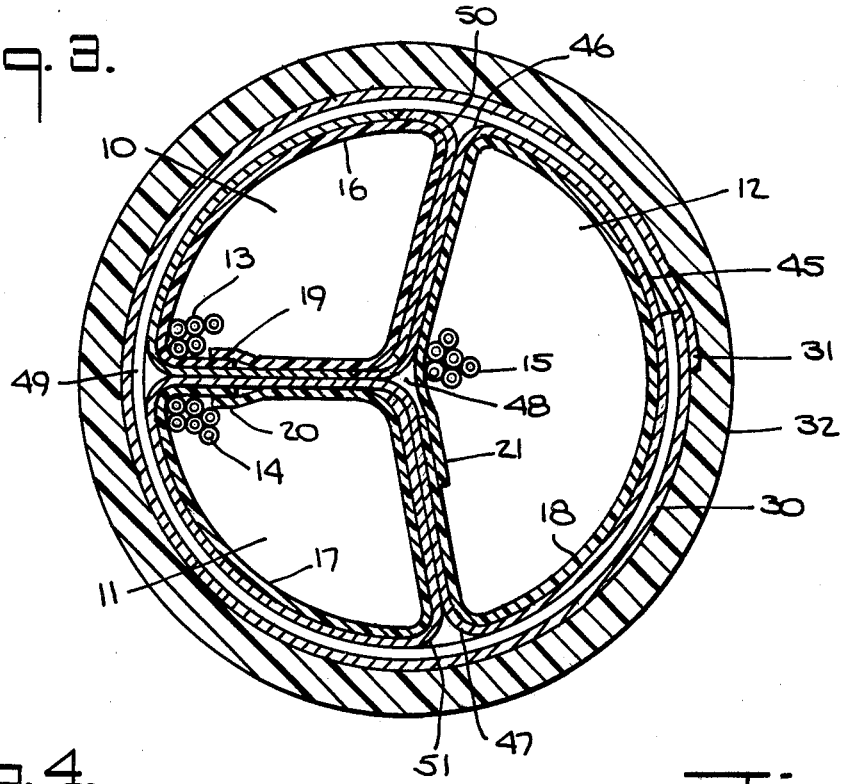
Fig. 4.
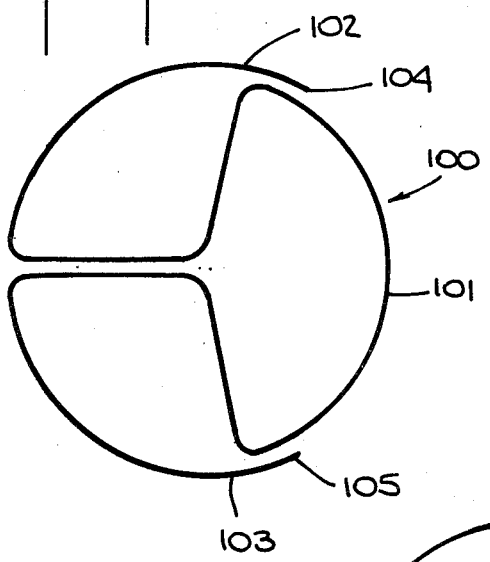
Fig. 5.
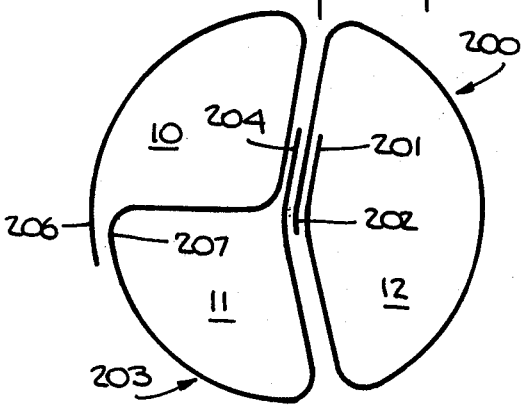
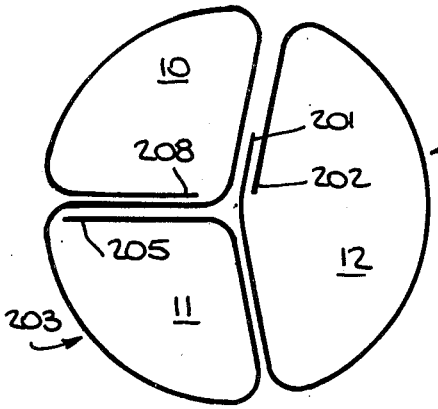
Fig. 6.

MULTI-COMPARTMENT SCREENED TELEPHONE CABLES

BACKGROUND OF THE INVENTION

The present invention relates to telephone cables and, more particularly, to internally screened cables.

The history of internally screened telephone cables dates back many years and, as suggested in U.S. Pat. No. 4,340,771, can be traced from as early as 1934 up to the present. Whereas initial concern was with transmitting signals of the same frequency in two directions within the same cable, recent efforts have been directed toward providing improved carrying capacity for Pulse Code Modulation (PCM) carrier signals. In such cables the wire pairs have been divided into two groups with the pairs in one group designed for use in transmitting signals in one direction and the pairs in the other group designed to handle signals in the other direction. In Jachimowicz et al. U.S. Pat. No. 3,803,340, issued Apr. 9, 1974, there is described a cable construction that met adequately the established industry standards for 24-channel PCM carrier transmission at 772 KHz. But industry pressures for greater capacity gave rise to the invention covered in Gabriel et al. U.S. Pat. No. 4,165,442, issued Aug. 12, 1979, capable of meeting industry requirements for 48-channel PCM carrier transmission at 1.576 MHz.

Currently, the general practice is to employ separate cables to handle PCM signals on the one hand, and voice frequency (VF) signals and D.C. on the other hand. It should be understood that various control functions and the like require low frequency or D.C. signals. Consequently, there are many installations where because of the need for VF signal carrying capacity it is not economical to add an additional cable to handle the PCM carrier signals, and the advantage of PCM carrier transmission can not be obtained. Often, the underground ducts do not have the physical capacity to accommodate additional cables. Therefore, there is a considerable need for a single cable that can be substituted for the existing VF cable, that will retain the VF signal carrying capacity, and will add PCM carrier capacity.

In producing a composite cable it must be remembered that conventional PCM carrier practice calls for the installation of in-line repeaters having separate but adjacent channels within a single housing for signals in opposite directions. Thus, a weak signal from one wire pair enters the repeater, is amplified, and leaves the repeater as a strong signal while in an adjacent channel a weak signal coming in the opposite direction enters its corresponding repeater. Any crosstalk or leakage from the strong signal to the weak will cause undesirable interference. Therefore, a high degree of isolation between pairs is required. As mentioned previously, the Jachimowicz et al. and Gabriel et al. inventions provided an answer to the PCM carrier transmission problem. In addition, attempts have been made to handle both VF circuits and PCM carrier signals in a single cable by judiciously selecting the wire pairs that will carry the respective signals. However, this technique has proven to be unsatisfactory for various reasons among which is that arising from the fact that it has been difficult to control the physical location of the selected pairs along the cable throughout its entire length, and avoidance of interference was based upon maintaining a selected spacial relationship of the individual pairs with one set of pairs acting as a screen between the other pairs.

It is therefore an object of the present invention to provide a new cable construction that is capable of handling simultaneously PCM and VF signals in a convenient and economical manner with sufficiently low near end crosstalk to meet industry standards. It is an object at the same time to provide a cable that will meet other industry requirements such as that relating to protection from external hazards such as lightning or other high voltage phenomena.

SUMMARY OF THE INVENTION

It has now been discovered that it is possible to divide the conductors in a single cable structure into at least three separate groups and provide sufficient isolation between the groups that both PCM carrier and VF signals can be transmitted simultaneously therethrough while meeting industry standards for near end crosstalk. This can be accomplished while adequately shielding the entire cable from external high voltage penetration.

In accordance with the present invention there is provided a communication cable having at least three cable cores shaped and bundled together so that each of said cores is in confronting broad surface contact with at least two others of said cores and so that said bundled together cores have a generally circular radially outer boundary, characterized in that at least two of said cable cores have a first character with equal wire size and equal number of pairs enabling each of said two cores to carry PCM carrier messages in a different direction one from the other, at least one of said cores other than said two cores has a second character different from said first character and capable of carrying control and voice frequency signals in both directions, each of said cores of said first and second character including a plurality of individually insulated conductors of a gauge appropriate to the signal service for which the respective core is intended, a metal screen around at least each of said cores of said first character with a portion of said screen extending between adjacent ones of said cores of said first character to shield the conductors within each of said cores of said first character from interference arising outside of the respective core, and means for unifying all of said cores in said bundled together relationship.

BRIEF DESCRIPTION OF THE DRAWINGS

The invention will be better understood after reading the following detailed description of the presently preferred embodiments thereof with reference to the appended drawings in which:

FIG. 3 is a view similar to FIG. 1 showing another modification thereof;

FIGS. 4, 5 and 6 are diagrammatic illustrations of further modifications of the screen construction applicable to the embodiment of FIG. 1;

The same reference numerals are used throughout the drawings to designate the same or similar parts.

DETAILED DESCRIPTION OF THE PREFERRED EMBODIMENTS

Figure 1:
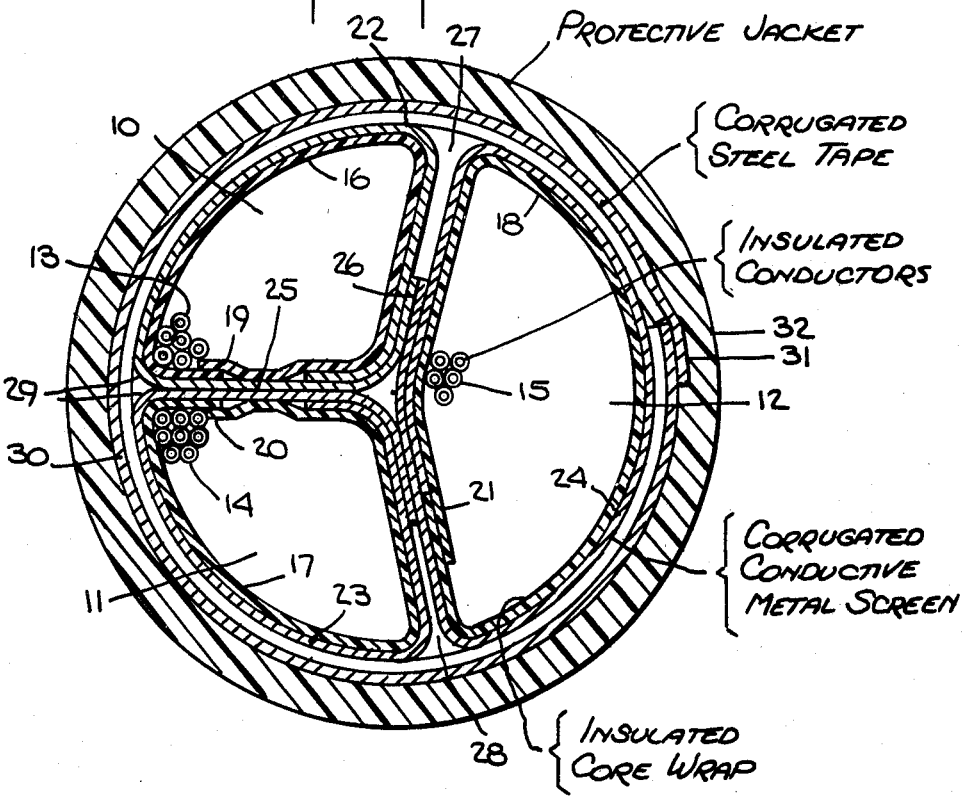
FIG. 1 is a cross-section through a cable embodying the present invention with the illustration somewhat exaggerated for clarity.

Reference should now be had to FIG. 1 wherein is illustrated one specific embodiment of the present invention, it being understood that the illustration is only exemplary, and that numerous alternatives in construction will be discussed below although not necessarily evident from a mere examination of the drawing. The illustrated cable has three cable cores 10, 11 and 12 of which the cores 10 and 11 are formed each from, for example, 27 pairs of 22 AWG insulated wire shown generally at 13 and 14, respectively, and capable of carrying PCM carrier signals or messages. The core 12 is formed from, again by way of example, 25 pairs of 19 AWG insulated wire, shown generally at 15, capable of carrying control and voice frequency signals.

Within each of the cores 10, 11 and 12, the respective conductors, 13, 14 and 15, are surrounded by an individual core wrap, 16, 17 and 18, respectively, of insulating material. While each of the core wraps 16, 17 and 18 is shown as a longitudinal wrap with respective overlaps at 19, 20 and 21, the wrap could be a sleeve extruded directly over the bundled insulated conductors. Alternatively, the core wrap could be produced by spiral wrapping tape with slight side edge overlap. On the other hand, the core wrap is optional and can be omitted, if desired, from all or some of the cores.

In the embodiment of FIG. 1 a metal screen of electrically conductive material in the form of a tape, preferably corrugated, is wrapped longitudinally about each core with a portion of the screen extending between adjacent cores to shield them electrically from each other. As shown, a screen 22 is wrapped about the core 10 with an overlap near the center of the cable. The screen 22 is spaced from all of the conductors 13 of the core 10 by the core wrap 16 that is interposed between the inside surface of the metal screen 22 and the conductors 13 of the corresponding core 10. If the core wrap 16 is omitted, the screen 22 would be in direct contact with the insulated conductors 13.

Similarly, cores 11 and 12 are provided with metal screens 23 and 24, respectively. It will be observed that the cores 10, 11 and 12 with surrounding metal screening are each in confronting broad surface contact with at least two other cores. For example, core 10 with its metal screen 22 contacts in the region 25 the screen 23 of core 11. Simultaneously, screen 22 contacts in the region 26 the screen 24 of core 12. While not shown in the drawing, the subsequent application of sheathing to the assembled cores will usually deform the cores, the thickness of the screen material being exaggerated in the drawing, to cause cores 10 and 12 to engage in the region 27. Likewise, screens 23 and 24 of cores 11 and 12 will usually engage in the region 28.

For the purpose of unifying and strengthening the cable and protecting the cores, a protective sheath is provided surrounding the outer circular boundary 29 of the cores. The circular boundary 29 is provided by configuring the individual cores 10, 11 and 12 so that when assembled with the other cores they provide a generally circular radially outer boundary. In this example the protective sheath consists first of a longitudinal wrap 30 of a corrugated steel strip with an overlap at 31 that functions, inter alia, as a shield and over which is extruded a protective layer of material 32. Under certain circumstances, the steel strip 30 may be omitted or applied helically.

Figure 2:
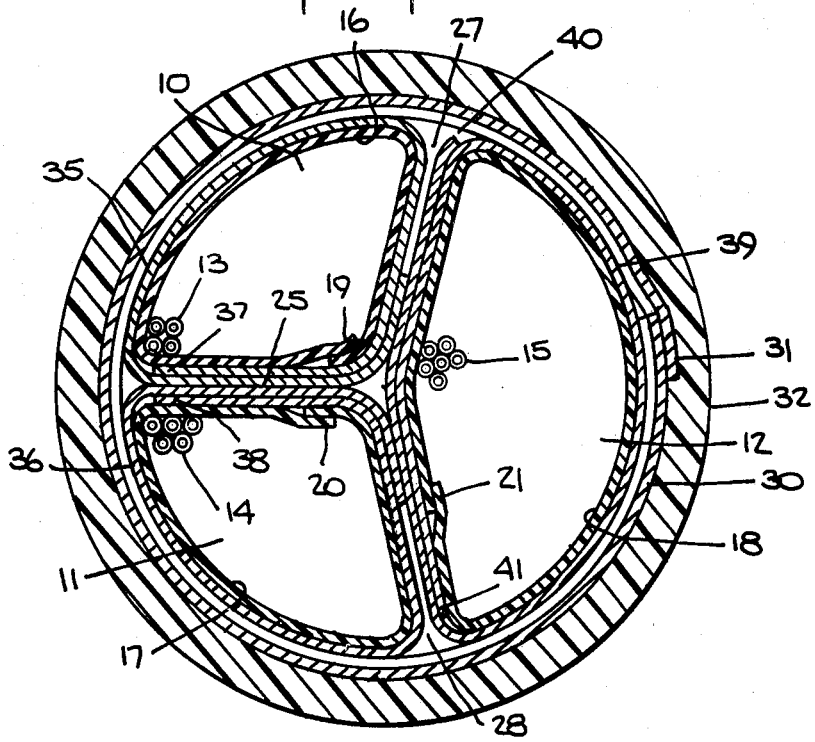
FIG. 2 is a view similar to FIG. 1 showing a modification thereof.

While in the embodiment shown in FIG. 1, the edges of the screens overlap significantly, it may be desirable to increase the overlap, and thereby lengthen the path that any leakage flux has to traverse between the individual cores, in a manner such as shown in FIG. 2. Thus, the inside edges 37 and 38 of screens 35 and 36, respectively encircling cores 10 and 11, have been extended radially outwardly providing four overlapping layers of metal screening in the region 25 separating the cores 10 and 11. Similarly, the edges of the metal screen 39 at 40 and 41 have been extended radially such that there is at least three layers of screening material between the core 12 and each of the cores 10 and 11.

In the embodiments of FIGS. 1 and 2 the cores 10, 11 and 12 are individually wrapped in separate screen elements or tapes and then assembled to provide a circular core structure that is unified by the surrounding steel and protective jacket. However, it may be more economical to fabricate the cable with one continuous screen element surrounding all of the cores. An example of such construction is shown in FIG. 3 wherein the screen member 45 extends circumferentially about the core 12 to the corners 46 and 47 whereupon the screen turns radially inwardly with both sides coming together in the vicinity of the center of the cable at 48 and then continuing radially outwardly to the region 49 where the portions diverge and extend circumferentially in opposite directions around the respective cores 10 and 11 to the corners 50 and 51. From corners 50 and 51 the side edges of the screen member are turned radially inwardly back to the center of the cable. In this manner, as will appear from the drawing, two complete layers of metal screening are provided between each of the intercore boundaries. The remainder of the cable construction can be the same as that described previously with reference to FIG. 1.

Figure 9:
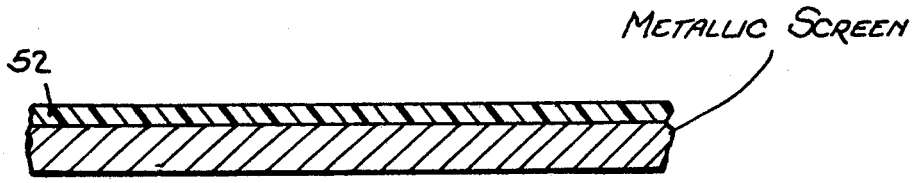
FIGS. 9 and 10 are enlarged, somewhat exaggerated, fragmentary sections through screen material showing optional plastic coatings thereon.
Figure 10:
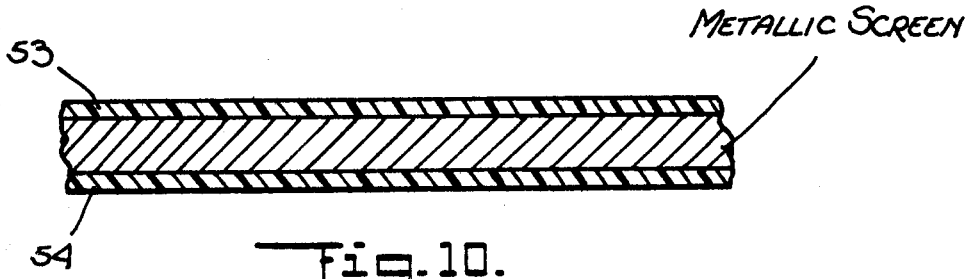

With regard to all of the embodiments illustrated in FIGS. 1, 2 and 3, it should be understood that the number of conductor pairs and the gauge of the individual conductors can be altered as desired to meet the intended signal carrying requirements. While corrugated screen material is preferred, and as presently contemplated such material is aluminum, the aluminum may be either plain or coated with a thin protective layer of plastic material on one or both sides such as shown at 52 in FIG. 9 and at 53 and 54 in FIG. 10. Instead of aluminum, the screen material can be of copper or conductive alloys, it can be laminated with a combination of metals, and variously coated, all in a manner known to the dual compartment cable art. Flat tape may be used rather than corrugated material. However, it is believed that the corrugated material produces a more flexible cable structure and gives rise to increased flex life. The protective coating on the aluminum or other metal is often desired in order to minimize corrosion if moisture should enter the cable.

The core wraps 16, 17 and 18 can be constructed of any suitable dielectric tape material providing additional dielectric strength between the conductors and the surrounding metal screen material, as desired.

The steel tape 30 may also have a protective coating thereon or a flooding compound on one or both sides and, although a corrugated tape is preferred, there may be instances where flat tape might be desired. Flexibility and flex life normally constitute the controlling factors in the choice of the steel material 30. The steel member 30 improves the shielding efficiency of the cable with regard to external sources of interference. However, other metals or laminates of plural metals with various surface coatings or treatment may also be used.

The protective jacket 32 is preferably bonded to the outer surface of the member 30 preventing relative movement therebetween as the cable is bent and restricting the ingress of moisture.

By way of summary, it should be apparent that each of the cores 10, 11 and 12 has a cross-section that is mutually complemental with adjacent cores for generally maximizing the ratio of the number of conductors 13, 14 and 15 in the cable relative to the cross-sectional area of the cable. In other words, the subject cable construction provides a dense pack of the insulated conductors that substantially fills the space within the sheath 30 and 32 except for being separated from said sheath and into the respective cores 10, 11 and 12 essentially solely by the core wraps 16, 17 and 18 of insulating material, when utilized, and the metal screens 22, 23 and 24 or 45. The metal screens are fabricated from thin metal tapes or the like, generally having a thickness no greater than about 12 mils.

It should also be understood that the corrugation referred to throughout this description, both with respect to the metal screen components and the steel sheathing component, is generally normal to the longitudinal axis of the cable.

In FIG. 3, the screen member 45, in the form of a single tape of metal, has its side edges turned radially inwardly from the corners 50 and 51. This construction permits ready insertion of a cutting blade, knife or the like between the cores 10, 11 and 12 for separating the cores when end fittings, splices or other connections are to be attached or made to the cable.

Instead of the construction shown in FIG. 3, there may be circumstances under which the screen configuration shown in FIG. 4 may be desired. The illustration is entirely diagrammatic showing the screen 100 as extending between the point 101 and the end points 102 and 103 essentially the same as in the embodiment of FIG. 3. The embodiment of FIG. 4 differs from that of FIG. 3 in that the side edges are no longer turned radially inwardly but continue circumferentially beyond points 102 and 103 in an overlapping relationship to end points 104 and 105. In all other respects, it is contemplated that the construction will be the same as described with reference to FIG. 3.

The embodiment of FIGS. 1 and 2 contain separate screen members for each bundle of conductors or core. On the other hand, the embodiments of FIGS. 3 and 4 contain a single screen member enveloping all of the cores. Manufacturing or end use requirements may, however, make it more attractive to surround certain cores by an individual screen singly while surrounding other cores by a single screen collectively as a group. Two such examples are illustrated in FIGS. 5 and 6 wherein one core, for example the VF core 12, is enclosed within a screen member 200 with overlapping side edges 201 and 202, while the cores 10 and 11 are enclosed collectively by a solitary screen member 203. In FIG. 5, the side edge 204 extends from the cable center radially outwardly between cores 10 and 12, while in FIG. 6, the comparable side edge 205 continues around core 11 between cores 10 and 11. Similarly, in FIG. 5, the side edge 206 continues circumferentially overlapping the corner 207, while in FIG. 6, the comparable side edge 208 is tucked radially inwardly, also between cores 10 and 11. It is contemplated that the remaining details of construction will be the same as described with reference to FIGS. 1 to 3.

In all of the embodiments described to this point, all of the cores are enveloped in a metal screen member of good electrical conductivity such as aluminum or copper. However, the electrical isolation problem differs depending upon the signals to be handled by the particular core or cores. For PCM carrier service it is generally considered necessary to have balanced cores with equal wire size and equal number of pairs. Because of the frequencies involved and signal levels, good isolation is required between the cores handling transmission in opposite directions. Wrapping the cores intended for carrier service with a metal screen provides the requisite isolation even when the cores are in broad surface contact with screen-to-screen engagement. At the same time, the screen member or members around the cores intended for carrier service separate the last mentioned cores from adjacent cores intended for voice frequency service. While affording acceptable isolation as between the cores, it is still desirable, if not absolutely necessary, that the entire assembly of cores be protected from lightning and all other sources of high voltage and this is accomplished by a steel tape longitudinally or spirally wrapped around the entire assembly. The steel tape is then protected by an external jacket, the jacket and steel tape wrapping being construed collectively as a sheath. In any case, the jacket and/or steel wrap serve to unify the cores in assembled relationship.

Figure 7:
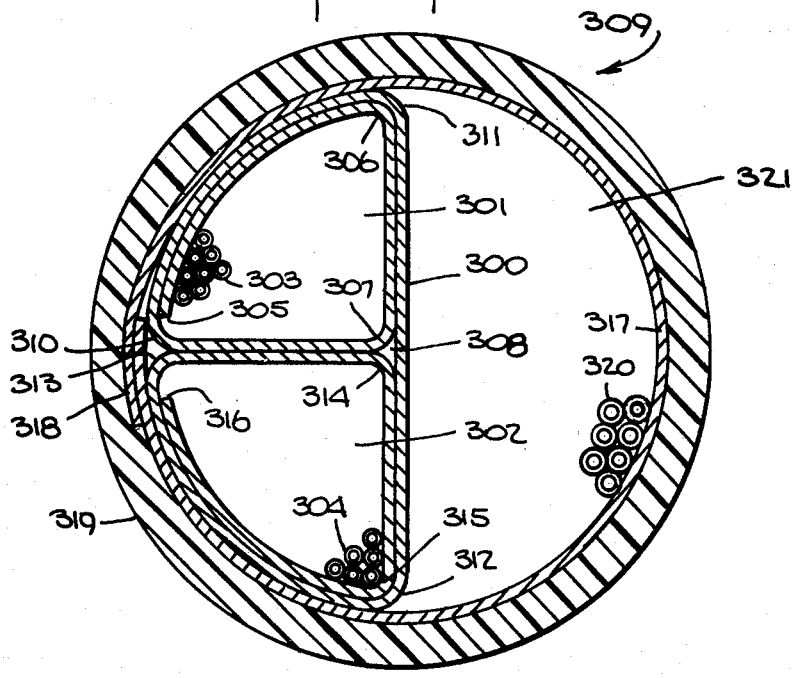
FIG. 7 is a view similar to FIG. 1 showing an embodiment wherein the screen surrounds only certain of the cores.

For the purpose of illustrating the modification wherein a screen wrap is not included around the voice frequency core, FIG. 7 has been included. Attention should now be directed thereto wherein a single tape 300 serves to envelop the cores 301 and 302 containing insulated wires 303 and 304. Starting at the side edge 305, the tape 300 extends circumferentially about core 301 to corner 306 from which it extends radially inwardly to another corner 307 adjacent to longitudinal axis 308 of the cable 309. From corner 307, the screen tape progresses radially outwardly to corner 310 and passes circumferentially therefrom on the outside of the lateral portion having edge 305 until corner 311 is reached coinciding essentially with corner 306. From there the tape extends diametrically across the entire cable to corner 312, circumferentially in a clockwise direction to corner 313 then radially inwardly to corner 314 from which it progresses radially outwardly to corner 315 alongside corner 312. Finally it turns and extends circumferentially to edge 316. As shown, each of cores 301 and 302 is surrounded by two layers of screen tape on essentially all sides.

A length of steel tape 317 surrounds the entire core assembly with an overlap in the region 318. The steel has adequate strength for mechanically stiffening the cable while it has sufficiently low conductivity to afford lightning protection and the like. A jacket 319 of protective material is applied to the exterior of shield tape 317. The steel tape also serves to bundle the voice frequency pairs represented by insulated conductors 320.

In general, the conductors 320 will be of heavier gauge than conductors 303 and 304. This often is necessary because of the significantly higher currents handled by the voice frequency pairs.

As illustrated in FIG. 7, the insulative core wraps have been omitted. However, the cores 301 and 302 and/or the core 321, can be provided with such wrap or wraps, as desired.

Figure 8:
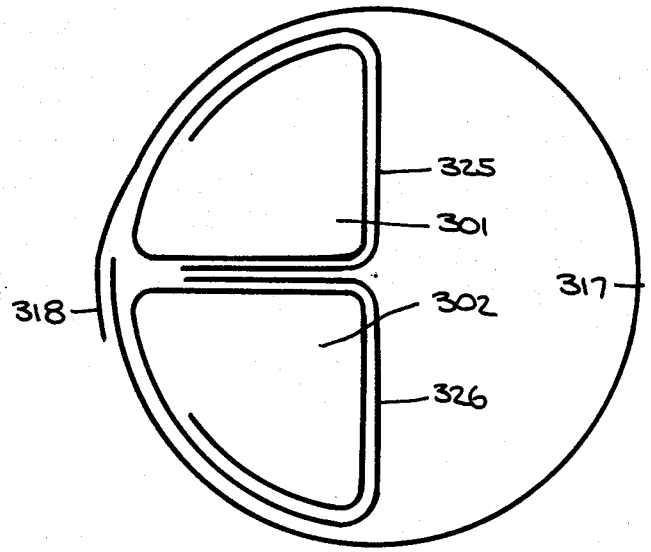
FIG. 8 is a diagrammatic illustration of a modification of the screen construction applicable to the embodiment of FIG. 7.

FIG. 8 illustrates a still further variation wherein each of cores 301 and 302 is provided with an individual screen tape 325 and 326, respectively, the core 301 being wrapped in a clockwise direction as viewed in the drawing while the core 302 is wrapped in a counter-clockwise direction. In all other respects the embodiment of FIG. 8 can be the same as that described with reference to FIG. 7.

Although the various embodiments shown in the drawings have three cores, it should be understood that the principle can be carried forward to encompass cables with any number of cores in excess of three. Also, any of the cables can be of the filled or un-filled variety, as desired.

Having described the presently preferred embodiments of the subject invention, it should be understood that various changes in construction may be introduced by those skilled in the subject art without departing from the true spirit of the invention as defined in the appended claims.

What is claimed is:

1. A communication cable having at least three cable cores shaped and bundled together so that each of said cores is in confronting broad surface contact with at least two others of said cores and so that said bundled together cores have a generally circular radially outer boundary, characterized in that at least two of said cable cores have a first character with equal wire size and equal number of pairs enabling each of said two cores to carry PCM carrier messages in a different direction one from the other, at least one of said cores other than said two cores has a second character different from said first character and capable of carrying control and voice frequency signals in both directions, each of said cores of said first and second character including a plurality of individually insulated conductors of a gauge appropriate to the signal service for which the respective core is intended, a metal screen around at least each of said cores of said first character with a portion of said screen extending between adjacent ones of said cores of said first character to shield the conductors within each of said cores of said first character from interference arising outside of the respective core, and means for unifying all of said cores in said bundled together relationship.

2. A cable according to claim 2, characterized in that each one of all of said cores has a cross-section that is mutually complemental with adjacent cores for generally maximizing the ratio of number of said conductors to the cross-sectional area of said cable.

3. A cable according to claim 1, characterized in that said metal screen comprises a longitudinal wrap of metal tape.

4. A cable according to claim 3, characterized in that said metal screen comprises a single length of said metal tape surrounding at least all of said cores of said first character.

5. A cable according to claim 3, characterized in that said metal screen comprises a plurality of said metal tapes equal in number to the number of said cores of said first character, each of said metal tapes encircling a different one of said cores of said first character.

6. A cable according to claim 3, characterized in that said metal screen comprises a plurality of said metal tapes with at least one of said metal tapes encircling a single one of said cores, and at least another of said metal tapes encircling a plurality of said cores exclusive of said single one of said cores.

7. A cable according to claim 3, characterized in that said longitudinal wrap of metal tape is corrugated with the individual corrugations extending generally normal to the longitudinal axis of the cable.

8. A cable according to claim 7, characterized in that an adherent thin layer of insulating material is coated upon at least one side of said metal tape.

9. A cable according to claim 8, characterized in that both sides of said metal tape is coated with said adherent material.

10. A cable according to claim 3, characterized in that said metal screen comprises a single length of said metal tape surrounding all of said cores individually.

11. A cable according to claim 3, characterized in that said metal screen comprises a plurality of said metal tapes equal in number to the number of all of said cores, each of said metal tapes encircling a different one of all of said cores.

12. A cable according to claim 1, characterized in that said cores of said second character include conductors of heavier guage than the cores of said first character.

13. A cable according to claim 1, characterized in that said means for unifying all of said cores includes a metal shield surrounding all of said cores collectively for protecting all of said conductors from high voltage penetration.

14. A cable according to claim 13, characterized in that said metal shield is surrounded by a protective jacket.

15. A cable according to claim 1, characterized in that at least each of said cores of said second character is surrounded individually by a core wrap of insulating material.

16. A cable according to claim 2, characterized in that each of all of said cores is surrounded individually by a core wrap of insulating material.

* * * * *

UNITED STATES PATENT AND TRADEMARK OFFICE

CERTIFICATE OF CORRECTION

PATENT NO. : 4,453,031

DATED : June 5, 1984

INVENTOR(S) : Jimmy D. Justiss

It is certified that error appears in the above—identified patent and that said Letters Patent is hereby corrected as shown below:

Column 7, line 52, "claim 2," should read --claim 1--.

Column 8, line 53, "claim 2," should read --claim 1--.

Signed and Sealed this

*Twenty-third* Day of *October 1984*

[SEAL]

*Attest:*

GERALD J. MOSSINGHOFF

*Attesting Officer*

*Commissioner of Patents and Trademarks*